US005618092A

United States Patent [19]

Doud et al.

[11] Patent Number: 5,618,092

[45] Date of Patent: Apr. 8, 1997

[54] FURNITURE DRAWER CONSTRUCTION

[75] Inventors: Galen C. Doud, Everett; Linn A. Steinbeck, Auburn, both of Wash.

[73] Assignee: Hon Industries Inc., Muscatine, Iowa

[21] Appl. No.: 493,919

[22] Filed: Jun. 23, 1995

[51] Int. Cl.[6] ..... A47B 88/04

[52] U.S. Cl. ..... 312/348.1; 312/348.2; 312/334.1; 312/262

[58] Field of Search ..... 312/348.1, 348.2, 312/334.1, 334.7, 262

[56] References Cited

U.S. PATENT DOCUMENTS

| | | | |
|---|---|---|---|
| 2,952,342 | 9/1960 | Schnittker | 52/658 |
| 3,556,626 | 1/1971 | Schock | 312/348.1 |
| 3,826,554 | 7/1974 | Cornell | 312/348.1 |
| 5,197,791 | 3/1993 | Domenig | 312/348.1 |

FOREIGN PATENT DOCUMENTS

| | | | |
|---|---|---|---|
| 1436532 | 5/1976 | United Kingdom | 312/348.1 |

OTHER PUBLICATIONS

Modern Plastics article, pp. 98–99, by Schock & Company Apr. 1966.

*Primary Examiner*—Peter M. Cuomo
*Assistant Examiner*—David E. Allred
*Attorney, Agent, or Firm*—Jones, Day, Reavis & Pogue

[57] ABSTRACT

A furniture drawer is constructed by providing a generally flat, elongate metal body member and manually bending the member to form a rear wall and a pair of side walls. Bending of the body member to form corners at the juncture of the side walls and rear wall is facilitated by transverse coined indentations in the body member which create lines of weakness in the body for accurately locating the corners. The body member is also formed with channels for receiving drawer slides and for receiving a bottom panel. Flanges formed at forward ends of the body member provide for attachment of a suitable drawer front. The drawer assembly as thus designed is capable of being economically packaged flat and shipped for easy assembly by the consumer.

3 Claims, 3 Drawing Sheets

FURNITURE DRAWER CONSTRUCTION

BACKGROUND OF THE INVENTION

1. Field of the Invention

The present invention relates generally to furniture drawer construction and, more particularly, to a novel construction wherein a drawer assembly for use in desks, cabinets or the like can be conveniently shipped to the consumer in compact form and is readily assembled at the intended destination.

2. Description of the Prior Art

Furniture pieces such as desks and cabinets, for example, are usually very bulky items. Their intended purpose is to store things and, accordingly, much of their bulk is taken up with space. As a consequence, these items are relatively expensive to ship from their point of manufacture to the ultimate consumer. Many forms of desks or cabinets because of their bulk are also easily damaged in shipment. Accordingly, the manufacturer must go to some lengths to adequately protect them with suitable packaging to anticipate possible damage in shipment.

Furniture is available which can be shipped in disassembled form for assembly by the consumer. In fact, such furniture has become popular in recent times largely because it can be both manufactured and shipped relatively inexpensively and resulting cost savings can be passed on to the consumer. In addition, growing numbers of consumers are becoming generally accustomed to purchasing merchandise of all kinds in unassembled form and then assembling it at the desired destination. As a result, many items can be purchased today which have been specifically designed to be easily assembled at their destinations by persons having even modest mechanical abilities and few tools.

Drawers are a component of some furniture which are by their typical construction quite bulky. The whole purpose of a drawer is to provide a container defining space within which items of various types may be stored. Accordingly, it is desirable to provide a drawer construction wherein the components of the drawer can be packaged essentially flat such that they are economically shipped and resistant to damage. It is further desirable to provide such a drawer construction which may be easily assembled at its intended destination. It is further desirable to provide such a drawer construction which has relatively few component pieces. Still further, it is desirable to provide such a drawer construction which is very sturdy in assembled condition and equals in quality and strength a typical premanufactured assembly.

SUMMARY OF THE INVENTION

The present invention improves over the prior art by providing a drawer assembly comprising a unitary body of stamped and formed metal which may be bent at right angles into a U-shaped configuration to form a pair of side walls and a rear wall of a drawer. The drawer body is provided with a lower channel for receiving marginal edge portions of a rigid panel, thereby forming a bottom of the drawer. The body further includes pairs of forwardly facing flanges formed on its two ends. The flanges serve for attachment of a suitable drawer front. At least one intermediate channel disposed between the top and bottom of the body is provided for receiving and supporting a drawer slide. Mitered notches are formed in the channels such that when the body is bent into its U-shaped configuration, the notched edges of the channels close, forming continuous corners at the rear of the drawer. Stamped or coined indentations are provided at the two lines in the body where the rear corners are to be formed, thereby assisting the assembler in bending the body at the proper locations.

BRIEF DESCRIPTION OF THE DRAWINGS

The foregoing and other novel features of the invention will be better understood by a reading of the following detailed description taken in conjunction with the accompanying drawings wherein.

DETAILED DESCRIPTION OF THE PREFERRED EMBODIMENT

Figure 1:
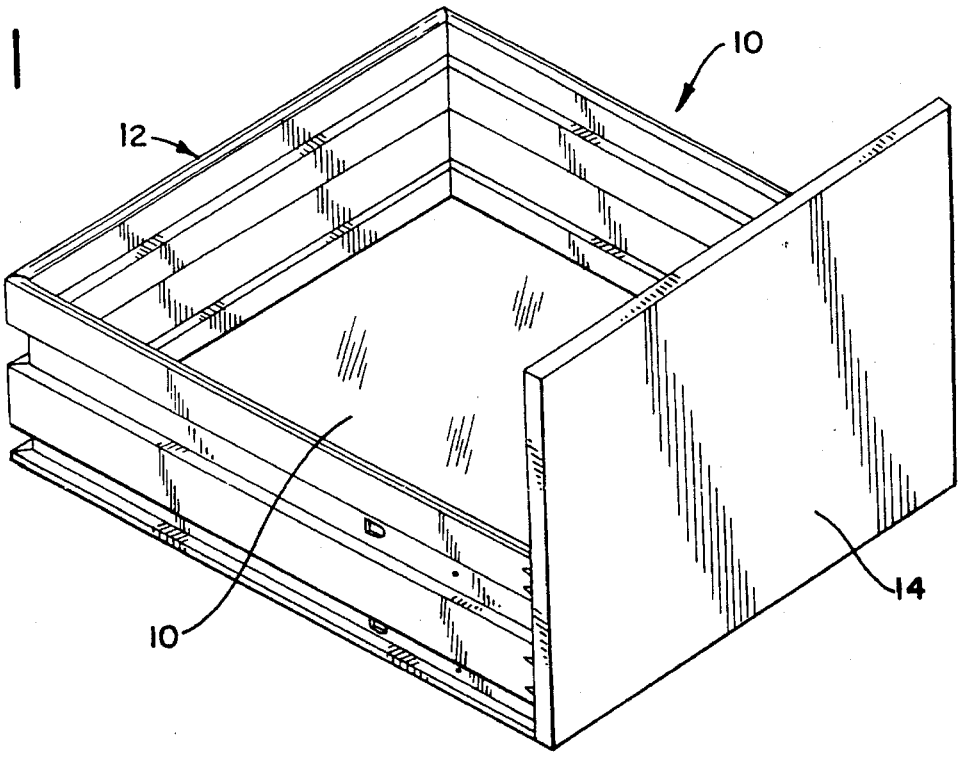
FIG. 1 is a perspective view of a cabinet drawer constructed in accordance with the principles of the invention.

Referring now to the drawings, and initially to FIG. 1, a drawer suitable for use in a cabinet or desk, for example, and constructed in accordance with the principles of the invention is designated generally by the reference numeral 10. The drawer 10 comprises as its principal components a drawer body 12, a drawer front 14 and a bottom panel 16. The drawer front 14 may be of any suitable construction such as wood, metal or particle board, for example. The bottom panel 16 may likewise be of a relatively thin sheet of wood, metal or press board. The body 12 of the drawer 10 is preferably stamped and formed from sheet metal.

Figure 2:
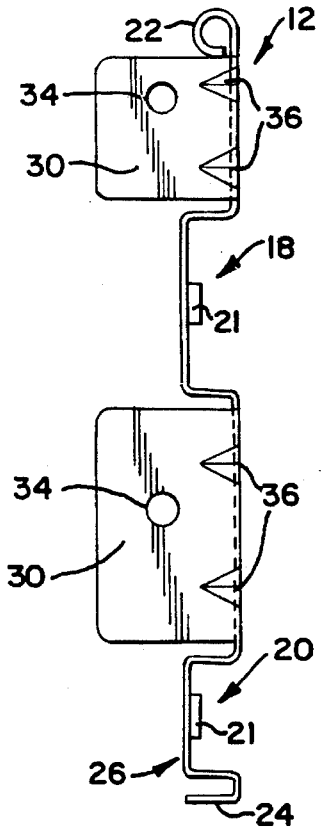
FIG. 2 is a plan view of a body for a cabinet drawer constructed in accordance with the principles of the invention.
Figure 3:
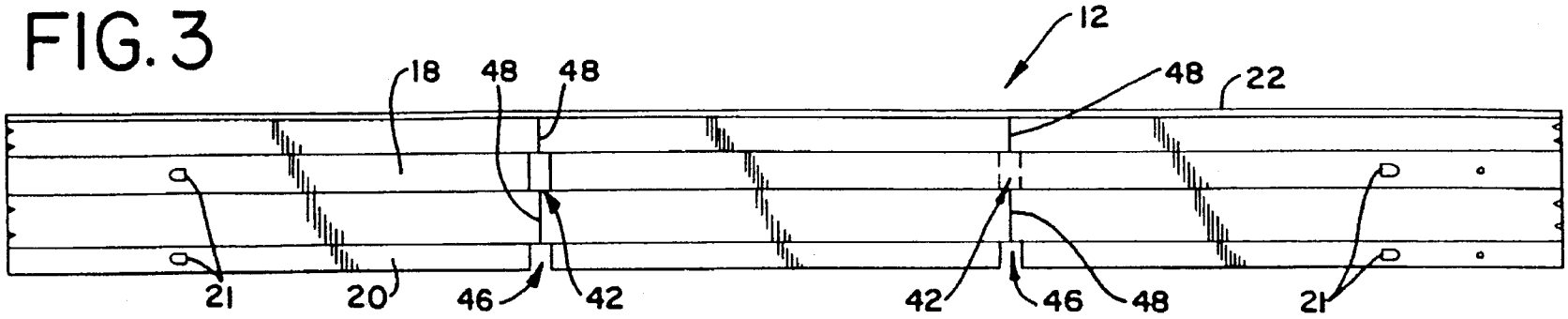
FIG. 3 is an end view of the body illustrated in FIG. 1.

Turning now to FIGS. 2 and 3, the drawer body 12 can be seen to be formed as a generally flat, unitary member defining lengthwise channels 18 and 20. The channels 18 and 20 serve to strengthen the body 12 and also provide means for receiving and supporting suitable drawer slides (not shown). Suitable tabs 21 may be formed in the channels 18 and 20 to retain the drawer slides in place. Also for strength and to provide a finished edge treatment, upper edge 22 of the body 12 is formed with a curl. Along lower edge 24, the body 12 is formed with a channel 26 which is dimensioned and configured to receive the bottom panel 16. As best seen in FIG. 3, each end of the body 12 is formed with a pair of spaced flanges 30 for attachment of the drawer front 14 as will be described hereinafter. Suitable apertures 34 are formed in each flange 30 for receiving screws or the like. Corner gussets 36 may be formed at the right angle bend of the flanges 30 for reinforcement.

Figure 4:
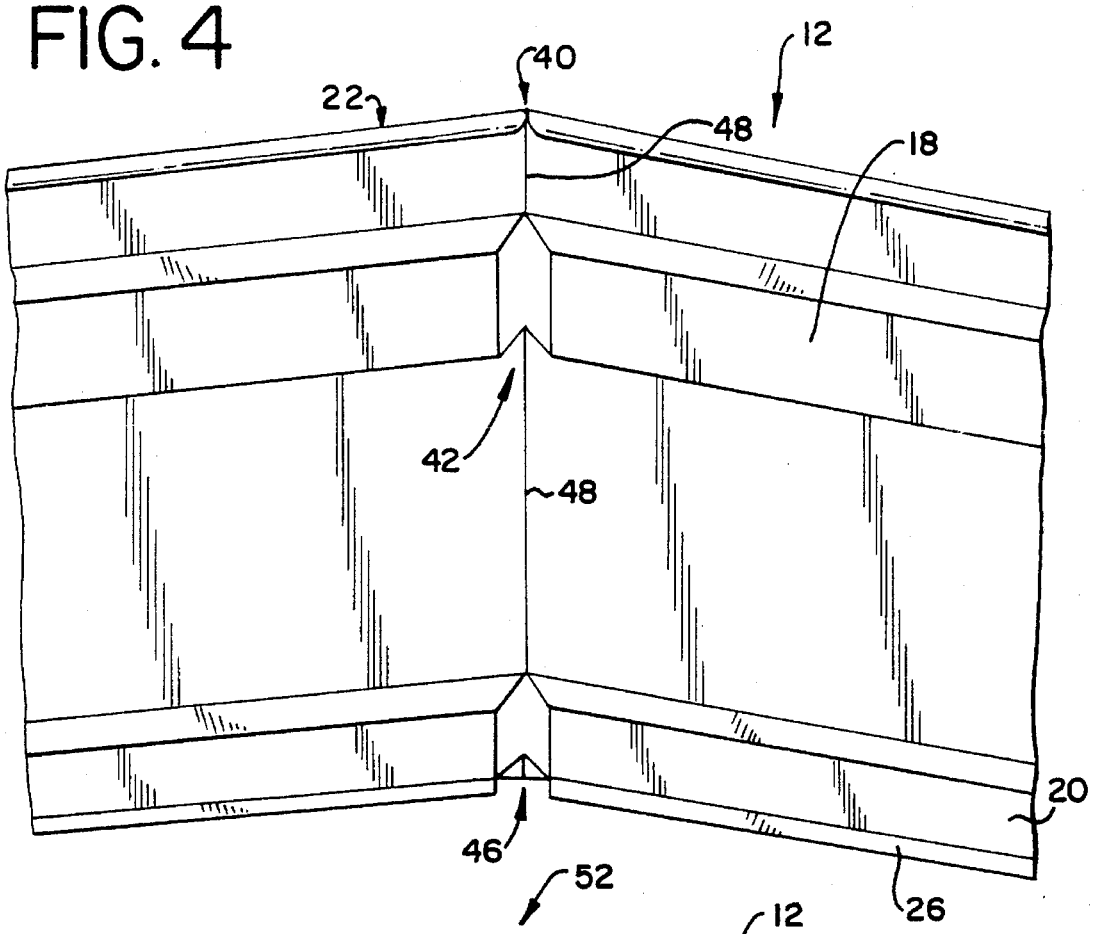
FIG. 4 is an enlarged perspective view of a rear corner portion of the drawer showing the drawer body in a partially bent condition.

Turning now to FIG. 4, a rear corner of the body 12 is illustrated in enlarged perspective showing the corner in a partially bent condition. Here it can be seen that in accordance with an important feature of the invention the body 12 is formed in a stamping process to define 45 degree mitered notches 40, 42 and 46 at the curled upper edge 22, the channel 18, and the channel 20, respectively. A transverse indentation 48 is also coined into the body 12 in vertical alignment with the notches 40, 42 and 46.

Figure 5:
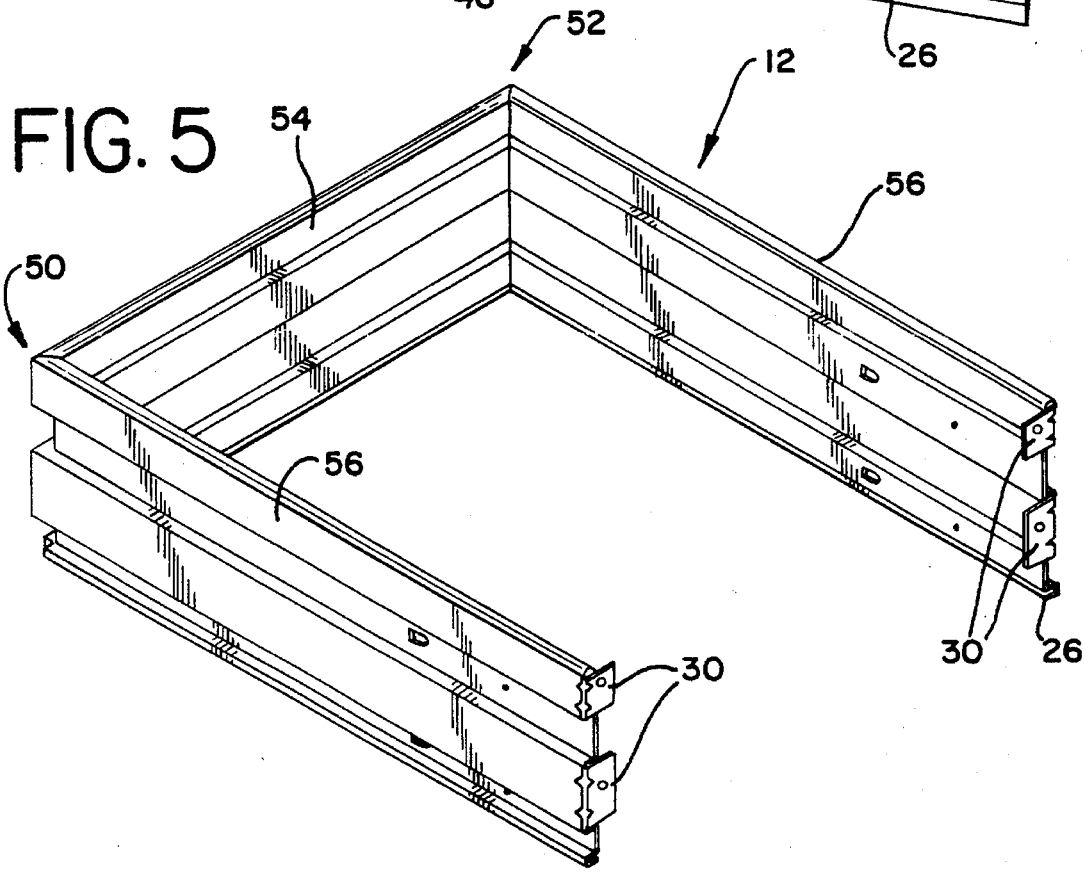
FIG. 5 is a perspective view of the body after it has been fully bent to form side walls and a rear wall of a drawer.

It can now be appreciated that a drawer 10 in accordance with the invention can be readily assembled by taking the flat body member 12 and manually bending it to define corners 50 and 52, a rear wall 54 and a pair of side walls 56 (see FIG. 5). The coined indentations 48 of the body 12 create lines of weakness in the body 12 which assure that the corner bends are properly located. With each side wall 56 forming a 90 degree angle with the rear wall 54, the mitered notches 40, 42 and 46 all close, forming a smooth transition between the edges 22 and channels 18 and 20 of respective walls 54 and 56. By such a construction, the drawer 10 has not only a finished visual appearance, but also contents of the drawer 10 cannot fall out at the corners 50 and 52. Once the body 12 has been bent to define a U-shape, as seen in FIG. 5, the bottom panel 16 may simply be slid into the channels 26 and the drawer front 14 may be installed on the flanges 30, thereby trapping the panel 16 in place.

It can be further appreciated that the drawer 10 of the present invention provides a highly desirable consumer product. Because of the flat nature of the body member 12 as initially formed, the drawer components consisting basically of the body member 12, the bottom panel 16 and the drawer front 14 can all be packaged flat and economically shipped to the consumer without risk of damage. Moreover, the consumer can readily assemble the drawer 10 with only the use of a standard screwdriver. The assembled drawer 10 is also very sturdy in construction and has an appearance of quality which equals that of a premanufactured drawer. The drawer 10 thus is capable of representing a substantial value to the consumer.

While the present invention has been described in connection with a preferred embodiment thereof, it will be apparent to those skilled in the art that many changes and modifications may be made without departing the true spirit and scope of the invention. Accordingly, it is intended by the appended claims to cover all such changes and modifications as come within the true spirit and scope of the present invention.

What is claimed is:

1. A furniture drawer comprising:

a unitary body member formed from a flat, elongate blank of metal to define a single thickness rear wall and a pair of single thickness side walls with a ninety-degree corner defined between each side wall and said rear wall, said body member having two forwardly projecting ends;

a drawer front secured to said ends of said body member;

an indentation in said body member running transversely thereof at each corner defining lines of weakness wherein said rear wall and side walls are formed by manually bending said body member from said flat, elongate form;

a first channel formed by a portion of said single thickness side walls and rear wall longitudinally of said body member said channel projecting inwardly of said drawer and opening outwardly of said drawer such that each side wall is configured to receive a drawer slide, said channel being interrupted at said corners with 45 degree mitered notches such that when bent to form said ninety-degree corners said channel makes a smooth continuous transition interior to said drawer between the side walls and rear wall at said corners; and a second channel formed longitudinally of said body member and opening inwardly of said drawer to receive and support a bottom panel.

2. The drawer of claim 1 wherein each end of said body member is provided with at least one flange for connection of said drawer front to said body member.

3. A furniture drawer comprising:

a unitary body member formed from a flat, elongate blank of metal to define a single thickness rear wall and a pair of single thickness side walls with a ninety-degree corner defined between each side wall and said rear wall, said body member having two forwardly projecting ends;

a drawer front secured to said ends of said body member;

each single thickness side wall and the single thickness rear wall forming a channel running the length thereof, said channels projecting inwardly of said drawer and opening outwardly of said drawer and being dimensioned and configured to receive drawer slides in the side walls of said drawer, said channels having 45 degree mitered notches formed therein at the corners such that the channels of the side walls form a smooth continuous transition with the channel of the rear wall interior to said drawer; and a pair of indentations in said corners of said body member, each indentation vertically aligned with and centered on the notches of adjacent channels, said indentations defining lines of weakness wherein said rear wall and side walls are formed by manually bending said body member from said flat elongate form.

* * * * *